US005950864A

United States Patent [19]

Cash et al.

[11] Patent Number: 5,950,864

[45] Date of Patent: Sep. 14, 1999

[54] MUSKET CAP IN-LINE CAPPER

[75] Inventors: Tedd D. Cash, Waunakee; James M. Parker, Hartford, both of Wis.

[73] Assignee: Cash Manufacturing Co., Inc., Waunakee, Wis.

[21] Appl. No.: 09/036,871

[22] Filed: Mar. 9, 1998

[51] Int. Cl.[6] ..... B65H 1/08

[52] U.S. Cl. ..... 221/227; 221/281; 221/309; 221/307

[58] Field of Search ..... 221/227, 226, 221/281, 309, 307, 312 R, 312 C

[56] References Cited

U.S. PATENT DOCUMENTS

| | | | |
|---|---|---|---|
| 35,524 | 6/1862 | Jones . | |
| 40,432 | 10/1863 | Seely . | |
| 1,385,086 | 7/1921 | Maranville | 221/307 |
| 2,274,238 | 2/1942 | Henderson et al. | 221/227 |
| 2,620,061 | 12/1952 | Uxa | 221/281 |
| 2,885,811 | 5/1959 | Womble, Jr. . | |
| 2,893,599 | 7/1959 | Kay | 221/281 |
| 3,283,425 | 11/1966 | Boyd . | |
| 3,292,293 | 12/1966 | Chiasera et al. . | |
| 3,992,796 | 11/1976 | Dorgnon . | |
| 4,180,192 | 12/1979 | Breslau | 221/281 |
| 4,845,874 | 7/1989 | Etheridge et al. . | |
| 5,078,076 | 1/1992 | Chestnut | 221/227 |
| 5,191,995 | 3/1993 | McDonald | 221/281 |
| 5,819,982 | 10/1998 | Brown | 221/312 R |

OTHER PUBLICATIONS

"MMP Capstar the Hunter's Capper," Blackpowder Hunting, Winter 1997, p. 14, Bradbury Communications Group, Glenrock, Wyoming.

Thompson/Center Arms, Catalog 22, Published 1995, p. 36.

Mountain State Muzzleloading, Catalog No. 20, 1996–1997, p. 52, Aug. 1996.

"#Capper–P Inline capper brass $8.50" Undated advertisement.

*Primary Examiner*—William E. Terrell
*Assistant Examiner*—Joe Dillon, Jr.
*Attorney, Agent, or Firm*—Lathrop & Clark LLP

[57] ABSTRACT

Flanged musket percussion caps are stored and dispensed from a portable hand held capper which has a linear channel defined in a housing formed of sheet material. The housing has a through channel which has a floor which is parallel to two partial top walls with a central slot. The top walls are connected to the floor by side walls which are inclined outwardly from the floor. By this inclined wall shape of the housing, the flanged caps are accommodated, while at the same time the narrow flanges of the caps are prevented from binding against any structure of the capper. The user presses a pusher forward to position a single cap through an outlet between a flexible steel spring and a dispensing wall, where the cap can be dispensed onto a black powder firearm nipple. The housing has a T-shaped hole in one side wall, through which caps can be loaded into the dispensing channel. Musket caps without a flange may also be dispensed from the capper.

18 Claims, 1 Drawing Sheet

MUSKET CAP IN-LINE CAPPER

FIELD OF THE INVENTION

The present invention relates to dispensers for caps in general, and to devices for storing and dispensing musket caps in particular.

BACKGROUND OF THE INVENTION

The history of the development of small arms is a centuries long story of continuous change and improvement, spurred by advances in physics and manufacturing, and responsive to military and civilian needs. The progression from flintlock to the automatic carbine may be looked at as an unrelenting replacement of one technology by a superior one, yet in actual practice, firearm usage is not so simple. Due to their cost and craftsmanship, weapons which may not be competitive in combat retain value in peaceful applications. In some instances, what would appear to be a technological dead end becomes a source of continuing sportsman interest.

A case in point is the black powder musket. Although seeing their last major military use in the United States in the Civil War, these firearms have won continuing interest from modern sportsmen. Not only are weapons constructed according to this 19th century technology of keen interest to historians and Civil War reenactors, but even hunters and target shooters find satisfaction in meeting the challenges of black powder musketry.

One type of black powder musket which last saw U.S. military use in the Civil War, employed a flanged-cup like cap known as a "top hat" cap. Civil War era soldiers typically carried these brass caps in a paper wrapper, and then in a box or bag, typically of leather, immediately before going into battle. Prior to firing the musket, the concave cap was removed from the bag and placed over the musket's nipple, preparatory to being struck by the hammer to ignite the black powder charge. Another capper for top hat caps has a generally teardrop shaped can, which the user must shake to force a single cap forward for application to the musket nipple.

Civil War soldiers fought under extremely challenging conditions, and often had to make do with inadequate or rugged equipment. Soldiers under discipline will adapt their practices as need be to the materiel on hand. The modern consumer and sportsman, on the other hand, desires some modicum of convenience in his sporting activities, even while using antique technology. Although a black powder musket cannot expect to compete with a semi-automatic rifle in terms of sequential fire rates, the modern black powder musketeer nevertheless could benefit from shooting accessories which can reduce the reloading time of the musket and contribute to effective firing.

Furthermore, in hunting, it can be dangerous to pursue game without a loaded weapon. Hence, before chase can be given it is necessary to reload and recap. The speed with which this can be accomplished is critical to the successful pursuit of game.

What is needed is a means for dispensing top hat musket caps which is speedy, convenient and economical.

SUMMARY OF THE INVENTION

The top hat musket cap dispenser of this invention handles flanged caps within a linear channel defined in a housing formed of sheet material. The housing has a through channel which has a floor which is parallel to two partial top walls with a central slot. The top walls are connected to the floor by side walls which are inclined outwardly from the floor. By this inclined wall shape to the housing, the flanged caps are accommodated, while at the same time, the narrow flanges of the caps are prevented from binding against any structure of the capper. A spring-loaded pusher urges the caps through an outlet between a flexible steel spring and a dispensing wall, where the cap can be dispensed onto a black powder firearm nipple. The housing has a T-shaped hole in one side wall, through which caps can be loaded into the dispensing channel. The in-line capper can also accommodate top hat musket caps from which the flanges have been trimmed off.

It is an object of this invention to provide a dispenser for top hat musket caps which consistently dispenses caps.

It is another object of the present invention to provide a dispenser for top hat musket caps which is compact.

It is a further object of the present invention to provide a dispenser for top hat musket caps which is easy to use.

It is an additional object of the present invention to provide an in-line musket cap dispenser which can accommodate both flanged and unflanged musket caps.

Further objects, features and advantages of the invention will be apparent from the following detailed description when taken in conjunction with the accompanying drawings.

DESCRIPTION OF THE PREFERRED EMBODIMENT

Figure 1:
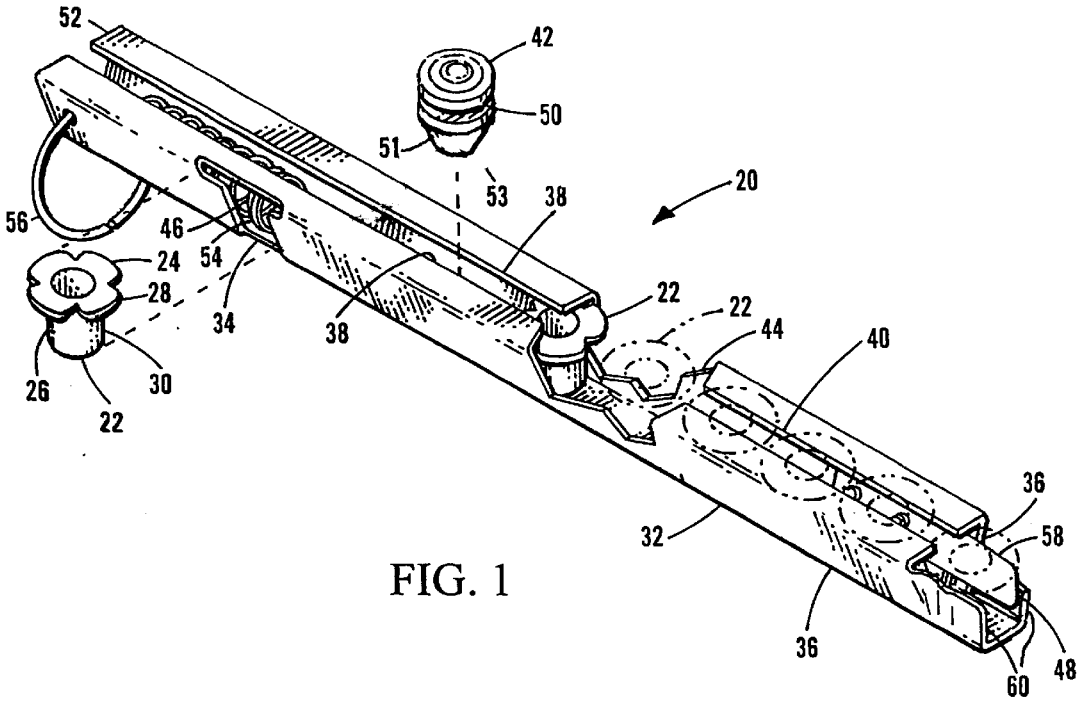
FIG. 1 is an exploded isometric view, partially broken away in section, of the top hat capper of this invention.
Figure 2:
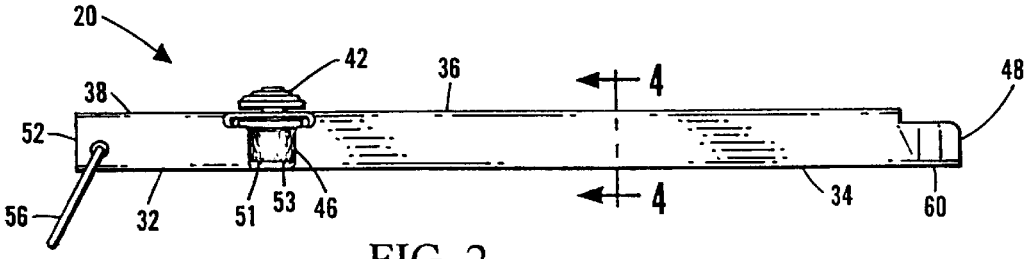
FIG. 2 is a side elevational view of the capper of FIG. 1.

Referring more particularly to FIGS. 1–4, wherein like numbers refer to similar parts, an in-line capper 20 for dispensing top hat percussion caps 22 is shown in FIG. 1. The top hat cap 22 differs from a simple cylindrical cap, in that it has a peripheral flange 24 which extends outwardly from a concave cup 26. The flange 24 may be made up of four or more petals 28, and extends generally perpendicularly to the cylindrical sidewall 30 of the cup. The cap 22 is typically stamped or otherwise formed from thin sheet brass, and has therein a primer charge which is activated by a percussive impact.

Figure 4:
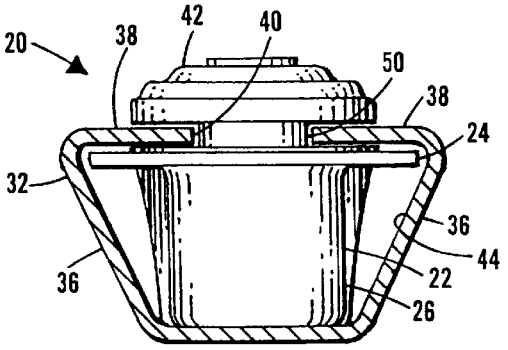
FIG. 4 is an enlarged cross-sectional view of the capper of FIG. 2 taken along section line 4—4.

The flanged nature of the top hat cap 22 can be an impediment to ready dispensing, because the flanges of adjacent caps 22 can tip and bind against the walls of the capper or with other caps. The capper 20 has a brass housing 32 formed from a bent sheet of brass. The housing 32 has a horizontal floor 34, from which two side walls 36 extend upwardly at an angle greater than perpendicular, for example about 120 degrees, as best shown in FIG. 4. A top wall 38 extends inwardly from each side wall 36, with the two top walls terminating along lines equally spaced from the center line of the housing to define a central slot 40 in which a pusher 42 slides axially. The side walls 36 are spaced from one another where they join the floor 34 a distance which is slightly greater than the diameter of the cylindrical cup 26 of the cap 22. The outwardly tilted side walls 36, where they join the top walls 38, are spaced from one another a distance which is slightly greater than the outer diameter of the cap 22 cup 26 flange 24.

The floor 34, the side walls 36, and the top walls 38 of the housing 32 define an axially extending channel 44 through which the caps 22 can slide from an inlet hole 46 in one side wall 36, to an outlet 48 defined between the ends of the two side walls. The pusher 42 is a generally cylindrical part which may be formed on a screw machine, and has a peripheral groove 50 into which the top walls 38 of the housing extend. The pusher has a beveled frustoconical surface 51 which is inclined from the flat base 53 of the pusher at about the same angle as the side walls 36 extend from the floor 34 of the brass housing 32. In assembly, the pusher 42 is inserted into the channel 44 from the rear 52 of the capper 20. A coil spring 54 is inserted after the pusher 42, and the channel 44 is closed at the rear 52 by a lanyard ring 56 or other obstruction. The coil spring 54 engages against the lanyard ring, and thus urges the pusher toward the cap outlet 48. The coil spring 54 serves to keep the pusher 42 positioned between the inlet hole 46 and the caps to prevent the escape of the caps through the inlet hole.

The cap inlet hole 46 is defined by portions of a housing side wall 36 and an adjacent housing top wall 38. The inlet hole 46 is generally T-shaped, with the cross of the T being defined at the juncture of the side wall 36 and the top wall 38, and being approximately as long as the diameter of the cap flange 24 and sufficiently tall to allow the flange to pass therethrough. The upright portion of the inlet hole T is as wide as the cup 26 of the cap 22 and extends to the floor 34 of the housing 32. To load a cap 22, the pusher 42 is retracted against the force of the spring 54 rearward of the inlet hole 46, and the cap is passed through the T-shaped hole. When pressure on the pusher 42 is released, the spring urges the pusher 42 past the inlet hole, thereby preventing the escape of the caps through the inlet hole. The pusher 42 itself, being captured by the extension of the housing top walls 38 into the groove 50, cannot pass through the inlet hole 46.

A flexible steel spring 58 is screwed or riveted to one side wall 36 of the housing at the outlet 48. The spring 58 is sufficiently flexible that it can be distorted by a user applying hand pressure to the pusher 42, yet is not so resilient that the coil spring 54 is sufficiently strong to distort it and eject caps entirely from the capper. The spring extends generally perpendicular to the floor of the housing, and is inclined or curved toward the opposite sidewall to retain the caps until extracted. Two dispensing walls 60, as shown in FIG. 1, extend frontwardly from the housing side walls 36. The flexible spring 58 is positioned inwardly of one dispensing wall. The dispensing walls 60 extend from the inclined side walls 36, but are bent to be approximately perpendicular to the top walls 38 of the housing. No top wall extends from the dispensing wall 60, so the dispensing wall may extend approximately adjacent the cup 26 of the cap 22. The housing floor 34 extends out along the dispensing wall 60 and is perpendicular to the dispensing floor.

Figure 3:
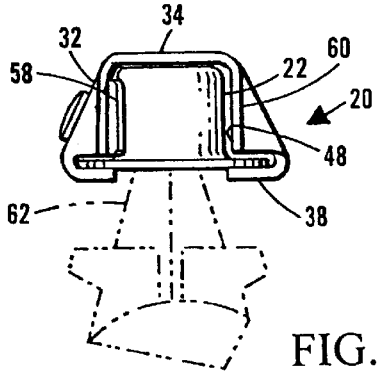
FIG. 3 is a front elevational view of a top hat cap being dispensed from the capper of FIG. 1 onto the nipple of a black powder musket shown in phantom view.

In use, the capper 20 is inverted as shown in FIG. 3, and the operator urges the pusher forward to eject a cap 22 from between the side walls 36 of the housing 32 to be engaged resiliently between a dispensing wall 60 and the flexible spring 58. The exposed opening to the concave cap 22 is positioned over the protruding nipple 62 of a black powder fire arm. Once the cap 22 is engaged by the nipple 62, the user withdraws the capper 20 from the nipple, causing the exposed cap 22 to flex the spring 58 and allow the cap to pass out of the capper. With the cap in position, and the weapon charged with powder and ball, the firearm is ready to be discharged.

A top hat cap travels smoothly through the housing channel 44, as the flange 24 is restrained by the top walls, and the bottom of the cup 26 is restrained by the housing floor 34. Excessive sideward tilting of the caps 22 is restrained by the side walls, yet some forward and backward tipping of the caps without binding is permitted.

If, after a particular shooting activity, not all the caps have been dispensed, the unused caps can be unloaded through the inlet by retracting the pusher, and can then be placed elsewhere for long term storage.

The housing 32 may be machined from tubular stock, but is preferably formed by folding up sheet stock into the disclosed shape. In addition, it should be noted that top hat musket caps which have been formed without the flanges, although not historically accurate, may also be dispensed from the capper 20.

It is understood that the invention is not limited to the particular construction and arrangement of parts herein illustrated and described, but embraces such modified forms thereof as come within the scope of the following claims.

We claim:

1. A dispenser for top hat percussion caps, the dispenser comprising:

an axially extending floor;

two side walls, one extending on either side of the floor, each side wall defining an angle with the floor that is greater than 90 degrees, such that the side walls diverge from one another;

a top wall which extends inwardly from each side wall, the two top walls extending toward one another to define an axially extending slot, side walls, and top walls defining an axially extending channel for receiving the caps which receives said top hat percussion caps therein, the channel extending from a cap inlet to a cap outlet; and a pusher engaged in the axially extending slot and slidable within the slot to move toward the cap outlet to bear against said top hat percussion caps in the slot.

2. The dispenser of claim 1 wherein the pusher comprises a body having a base which extends parallel to the floor, and having a frustoconical portion extending from the base, the frustoconical portions having a surface which extends from the pusher base at an angle approximately the same as the angle between the floor and the side walls.

3. The dispenser of claim 1 wherein each cap has a lower cup portion, with an outwardly extending flanged portion, and wherein one side wall and top wall has portions therein defining the cap inlet, and wherein the cap inlet is a T-shaped slot, such that the flanged portion of a cap extends through wide portions of the cap inlet, and the cup portion of a cap extends through narrower portions of the cap inlet.

4. The dispenser of claim 1 wherein the angle between each side wall and the floor is about 120 degrees.

5. The dispenser of claim 1 wherein at the cap outlet the floor extends axially from the termination of a side wall, and wherein a dispensing wall extends axially from a side wall, the dispensing wall extending substantially perpendicular to the floor.

6. The dispenser of claim 4 further comprising a flexible metal blade which is fastened to a side wall opposite the dispensing wall, such that a cap is resiliently engageable between the dispensing wall and the flexible metal blade.

7. A dispenser for top hat percussion caps, the dispenser comprising:

an axially extending floor;

two side walls, one extending on either side of the floor;

a top wall which extends inwardly from each side wall, the two top walls extending toward one another to define an axially extending slot, wherein the side walls are spaced a greater distance from one another at the top walls than at the floor, wherein the floor, the side walls, and the top walls define an axially extending channel extending from a cap inlet to a cap outlet, the side walls thus diverging from one another as they extend upwardly from the floor;

a pusher engaged in the axially extending slot to engage the caps in the channel, wherein a spring engages the pusher to urge the pusher toward the cap outlet; and portions of a side wall which define a sidewardly opening slot which serves as the cap inlet, the cap inlet slot allowing the introduction of caps into the channel, wherein the spring is compressible to allow the introduction of caps through the inlet slot, and is extendable to position the pusher between the cap inlet and the caps, to restrict escape of the caps through the inlet.

8. The dispenser of claim 7 wherein the pusher comprises a generally cylindrical body, having a base which extends parallel to the floor, and surfaces which extend from the pusher base at an angle approximately the same as the angle between the floor and the side walls.

9. The dispenser of claim 7 wherein each cap has a lower cup portion, with an outwardly extending flanged portion, and wherein the cap inlet is a T-shaped slot, such that the flanged portion of a cap extends through wide portions of the cap inlet, and the cup portion of a cap extends through narrower portions of the cap inlet.

10. The dispenser of claim 7 wherein the angle between each side wall and the floor is about 120 degrees.

11. The dispenser of claim 7 wherein at the cap outlet the floor extends axially from the termination of one side wall, and wherein a dispensing wall extends axially from the other side wall, the dispensing wall extending substantially perpendicular to the floor.

12. The dispenser of claim 11 further comprising a flexible metal blade which is fastened to a side wall opposite the dispensing wall, such that a cap may be resiliently engaged between the dispensing wall and the flexible metal blade.

13. A top hat musket cap dispensing assembly comprising:

a plurality of top hat musket caps having a generally cylindrical cup with peripheral outwardly extending flange portions;

a dispenser housing having an axially extending floor, two sidewalls which extend upwardly and outwardly from the floor, the sidewalls diverging from one another as they extend away from the floor, and top walls which extend inwardly from the top of each side wall, the floor, side walls and top walls defining an axially extending channel, wherein the caps are disposed within the channel, with the top walls extending above the flange portions, and wherein the two top walls extend toward one another to define an axially extending slot;

portions of a side wall which define a cap inlet;

a cap outlet defined between the side walls, wherein the top walls do not extend over the cap outlet, such that top hat musket caps are extractable upwardly at the cap outlet;

a pusher engaged in the axially extending slot so the top hat musket caps are positioned between the pusher and the cap outlet, the pusher engaging the top hat musket caps to urge them toward the cap outlet; and a spring which engages between the housing and the pusher to urge the pusher to a position forward of the cap inlet.

14. The dispenser of claim 13 wherein the angle between each side wall and the floor is about 120 degrees.

15. The dispenser of claim 13 wherein the pusher comprises a generally cylindrical body, having a base which extends parallel to the floor, and having a frustoconical surface which extends from the pusher base at an angle approximately the same as the angle between the floor and the side walls.

16. The dispenser of claim 13 wherein each cap has a lower cup portion, with an outwardly extending flanged portion, and wherein the cap inlet is a T-shaped slot, such that the flanged portion of a cap extends through wide portions of the cap inlet, and the cup portion of a cap extends through narrower portions of the cap inlet.

17. The dispenser of claim 13 wherein at the cap outlet the floor extends axially from the termination of one side wall, and wherein a dispensing wall extends axially from the other side wall, the dispensing wall extending substantially perpendicular to the floor.

18. The dispenser of claim 17 further comprising a flexible metal blade which is fastened to a side wall opposite the dispensing wall, such that a cap may be resiliently engaged between the dispensing wall and the flexible metal blade.

* * * * *

UNITED STATES PATENT AND TRADEMARK OFFICE

CERTIFICATE OF CORRECTION

PATENT NO. : 5,950,864
DATED : September 14, 1999
INVENTOR(S) : Cash et al.

It is certified that error appears in the above-identified patent and that said Letters Patent is hereby corrected as shown below:

Column 4,
Line 32, replace "side walls" with -- the floor, side walls --.

Column 5,
Line 7, replace "channel" with -- channel for receiving the caps --.

Signed and Sealed this

Second Day of April, 2002

*Attest:*

*Attesting Officer*

JAMES E. ROGAN
*Director of the United States Patent and Trademark Office*